United States Patent [19]

Pfeilsticker

[11] 4,333,646

[45] Jun. 8, 1982

[54] TENNIS PRACTICE AND TRAINING AID

[76] Inventor: Robert Pfeilsticker, 1815 Fite Ter., Langhorne, Pa. 19047

[21] Appl. No.: 62,862

[22] Filed: Aug. 1, 1979

[51] Int. Cl.[3] ..... A63B 69/38

[52] U.S. Cl. ..... 273/29 A

[58] Field of Search ..... 273/29 A, 30, 26 A, 273/127 R, 127 C

[56] References Cited

U.S. PATENT DOCUMENTS

| | | | |
|---|---|---|---|
| 2,104,375 | 6/1936 | Perry | 273/30 |
| 2,247,657 | 7/1941 | Girden | 273/30 |
| 2,447,743 | 8/1948 | Dieter | 273/30 |
| 2,595,725 | 5/1952 | Sutton | 273/30 |
| 3,569,544 | 7/1968 | Hedrick | 273/29 A |
| 3,692,307 | 9/1972 | Henry | 273/29 A |
| 3,697,068 | 10/1972 | McDougall | 273/29 A |
| 3,717,343 | 2/1973 | Hartfort | 273/30 |
| 4,026,551 | 5/1977 | Larson | 273/26 A |
| 4,065,126 | 12/1977 | Mantz | 273/29 A |
| 4,083,559 | 4/1978 | Owen, Jr. | 273/26 A |

FOREIGN PATENT DOCUMENTS

| | | | |
|---|---|---|---|
| 25767 | of 1901 | United Kingdom | 273/30 |

OTHER PUBLICATIONS

Washington Post, p. 42, 3/3/70.

*Primary Examiner*—Richard C. Pinkham
*Assistant Examiner*—T. Brown
*Attorney, Agent, or Firm*—Frederick A. Zoda; John J. Kane; Albert Sperry

[57] ABSTRACT

Disclosed is equipment whereby one may sharpen his or her skills in tennis, while practicing alone. The equipment is of the backboard type, incorporating an upright, panel-like structure located at one end of a surface which preferably is lined to simulate half of a tennis court of standard dimensions. The backboard is provided with a reflective surface, extending over the full width and height thereof, whereby the player sees his reflected image, with the image appearing at the opposite side of and being seen through the interstices of a net simulation incorporated in the reflectively surfaced area. A remarkably close simulation of actual playing conditions, providing a visual impression closely duplicating that which a player would experience when facing an opponent in a match, is thereby produced.

4 Claims, 9 Drawing Figures

Fig. 1.
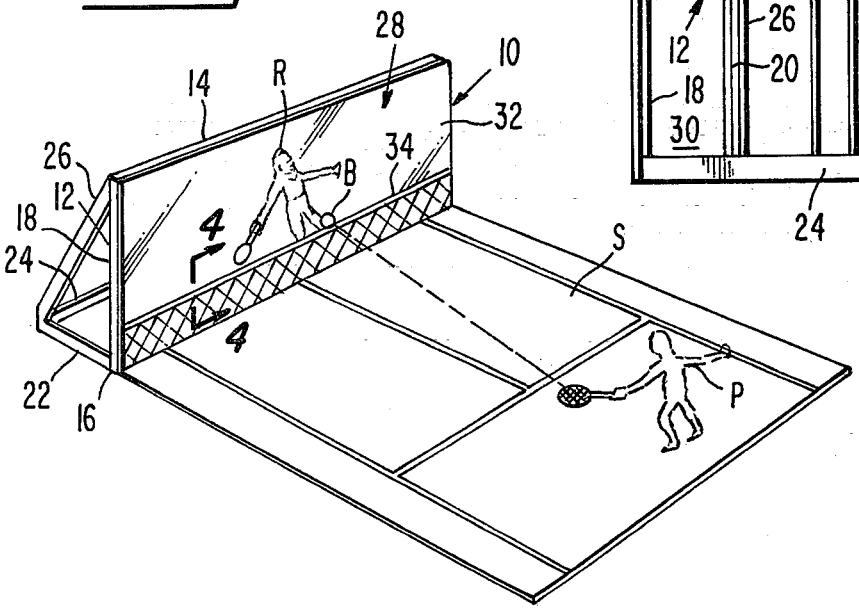
Fig. 2.
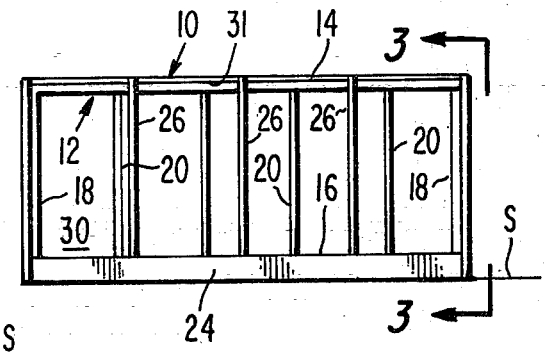
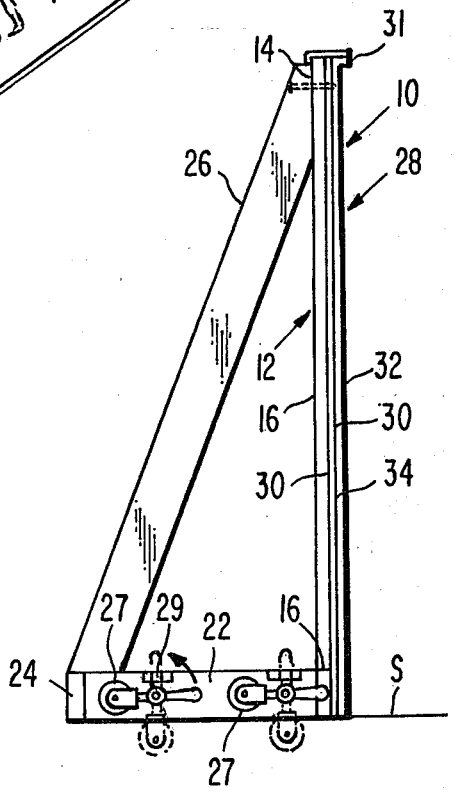
Fig. 3.
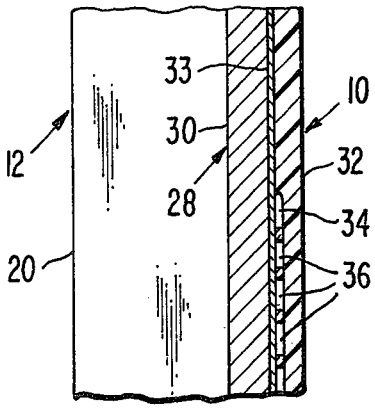
Fig. 4.
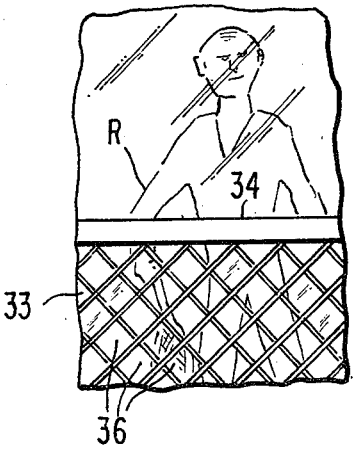
Fig. 5.

Fig. 6
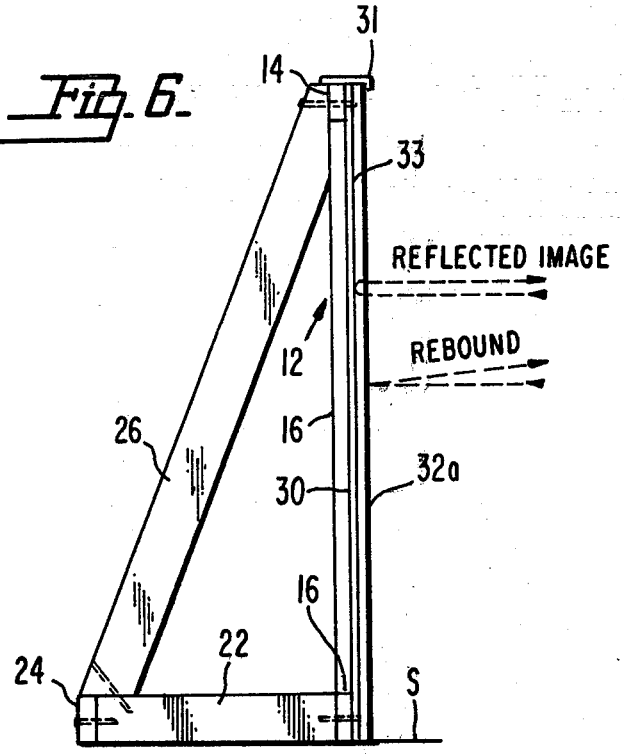
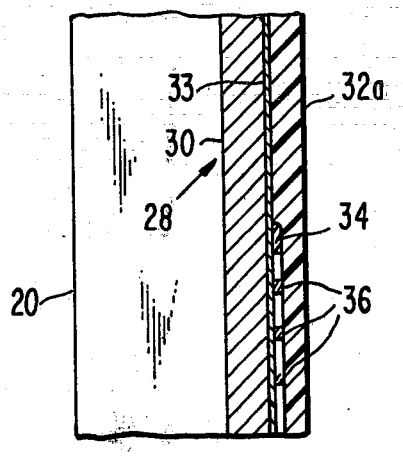
Fig. 7
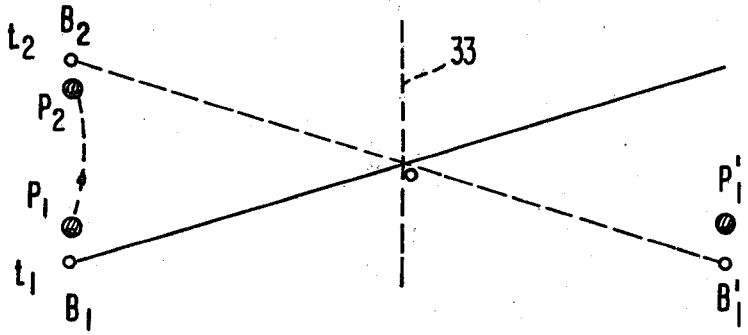
Fig. 8
Fig. 9
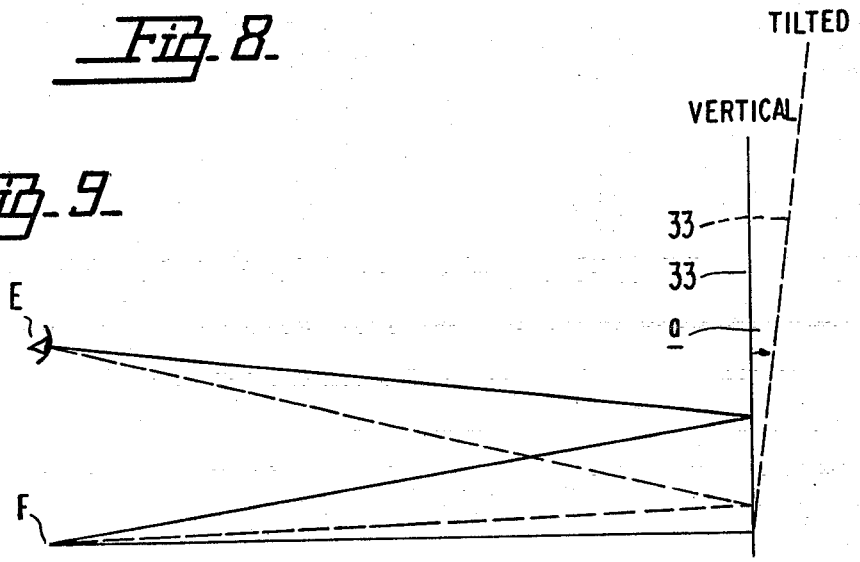

TENNIS PRACTICE AND TRAINING AID

BACKGROUND OF THE INVENTION

1. Description of the Prior Art

The invention relates generally to sports, and in particular relates to a practice aid, whereby one is enabled to practice the game of tennis alone, under realistic conditions which simulate closely an actual game in which opponents face each other across a net upon a tennis court of standard dimensions.

Heretofore, it has been proposed to provide backboards, and various aids of this type, whereby one can practice his or her tennis strokes and foot work. However, normally a backboard is no more than a blank, painted wall. This detracts considerably from the realism of the practice situation, and as a result, the interest of the player is difficult to sustain during a practice session. In addition, no real target is presented by conventional backboards, so that there is no incentive during the practice session, for the user to attempt to hit the ball to the target or, for that matter, away from the target as would be true in an actual tennis match. The prior art, thus, has so far as is known failed to suggest a backboard concept in which visual imagery is realistically incorporated, together with ball rebounding capability wholly consistent with the physical experience engendered by an actual tennis match in which opponent is pitted against opponent at opposite sides of the net of a wholly conventional court.

2. Summary of the Invention

Summarized briefly, the present invention includes a backboard structure, which in some instances may be made portable, so as to be movable into place across an actual tennis court, at mid court. The backboard in a preferred embodiment comprises an upright structure, which in height is dimensioned so as to assure that most practice strokes, except those which are badly mis-hit, will produce rebounding of the ball so that the players practice will be interrupted to a minimum extent.

In accordance with the invention, the backboard includes, preferably, a backing panel which may be opaque, and which is suitably reinforced by a support frame for the purpose of offering maximum rigidity and optimum rebounding characteristics. In the disclosed embodiment, the backboard is also provided with a front panel, overlying the entire area of and laminated with the backing panel. The front panel is transparent, and may be a highly impact resistant acrylic resin such as, for example, the product sold under the trademark "Plexiglas" by Rohm and Haas Co., Bristol, Pa. The front panel is reflectively surfaced, and overlying the reflective surface is the simulation of a tennis net, having interstices through which the reflective surface appears. An exceedingly faithful simulation of a complete tennis court is thus afforded to the user, by reason of the reflective surface and the net simulation, in that the player observes his or her own image in the reflective surface, and indeed observes the image below the top of the net, through the interstices of the net, exactly as an opponent would appear to a player in an actual playing situation.

It is proposed that in some instances, the reflective surface, while being maintained in a properly vertical position so as to reflect the player's image directly back to the player, may be in association with a rebounding surface which is inclined slightly from the horizontal, so as to impart a rebounding trajectory to the ball that will simulate more closely that which would be expected when an opponent returns the ball to a player over the net.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which;

FIG. 1 is a perspective view showing a tennis practice and training aid according to the present invention, as it appears when erected at one end of a playing surface lined to simulate half of a tennis court;

FIG. 2 is a rear elevational view of the aid;

FIG. 3 is an enlarged end elevational view thereof as seen from line 3—3 of FIG. 2;

FIG. 4 is a still further enlarged, detailed sectional view, substantially on line 4—4 of FIG. 1;

FIG. 5 is a fragmentary front elevational view, on an enlarged scale, of the backboard showing the reflected image as it appears in relation to the representation of the net;

FIG. 6 is a view similar to FIG. 3 showing a modified form;

FIG. 7 is a view similar to FIG. 4, showing in section the modified backboard construction of FIG. 6;

FIG. 8 is a schematic view showing how the reflective surface aids in simulating the direction of ball travel; and FIG. 9 is a schematic view showing the considerations entering into determining the angle of tilt of the reflecting surface of FIGS. 5 through 7.

DESCRIPTION OF THE PREFERRED EMBODIMENT

In the form of the invention shown in FIGS. 1 through 5, the tennis practice and training aid 10 is adapted to be erected at one end of a playing surface S which, as shown in FIG. 1, is lined to represent one half of a conventional tennis court, from the net to the base line. In the illustrated example, the playing surface has been lined to depict one half of a completely conventional court on which doubles can be played, but it will be understood that if desired, said playing surface could eliminate the doubles alleys, and could be lined solely as a singles court.

It is further contemplated, within the spirit of the invention as hereinafter claimed, that the practice aid 10 could be of portable or mobile construction, and could be wheeled or pushed into position across mid court, on a completely conventional tennis court. In this event, since the device incorporates the concept of inclusion of the representation of a net, the conventional net would be moved as a preliminary to movement of the device into position across mid court.

In accordance with the present invention, the preferred embodiment of the invention includes a generally rectangular backboard support frame 12, which includes horizontal top and bottom frame members 14, 16 respectively, that extend across the full width of the device, that is, from one to the opposite side of the playing surface S. Also incorporated in the backboard support frame are end frame members 18 which are vertically disposed, and a plurality of cross braces 20, which are also vertically positioned in a preferred embodiment, and which are secured in place between the top and bottom frame members.

In order to dispose the backboard support frame 12 in a vertical position, there are provided horizontal, rearwardly extending truss elements 22, secured at their rear ends to transverse truss elements 24. The elements 22, 24 are disposed in direct contact with the surface S. Connected between the transverse truss element 24 and the top frame member 14 are inclined truss elements 26.

By reason of this arrangement, the entire backboard support frame is maintained in a vertical position, and normally, the weight of the entire structure will be sufficient to keep it in such position during use by a player P.

In this connection, it is believed that in some instances, it may be desirable to increase the mobility of the structure, through the provision of retractable, swiveled casters or ground wheels 27 (see FIG. 3) which can be swung upwardly to the dotted line positions shown in FIG. 3, and retained in said positions through the provision of keepers 29, whenever it is desired to roll the structure into or out of a desired position, as for example across the middle of a conventional tennis court. For this purpose, the swiveled casters can be mounted on bars that are rotatable on the truss elements 22, about pivot pins carried by the truss elements, between the full and dotted line positions shown in FIG. 3. Other means for increasing the mobility of the structure can, of course, also be used.

Secured to the backboard support frame 12, and extending the full width and height of the rectangular frame, is a backboard 28 formed with a backing panel 30, which can be formed of a series of plywood panel members or any other suitably rigid, strong panel material. The backing panel 30, in a preferred embodiment, is disposed in a vertical position, and is suitably reinforced by having the top and bottom frame members 14, 16, and the end frame members and cross braces 18, 20, secured fixedly to its rear surface.

As protection against the elements, the top of the backboard 28 is protectively enclosed in a weather proof cap 31 adapted to prevent moisture from entering between the laminations of the backboard. Any other suitable expedient can, of course, be resorted to, to provide adequate protection against the elements at this or any other critical point of the structure.

Bonded or otherwise fixedly secured to the front surface of the backing panel 30 is a transparent facing member 32. In a preferred embodiment, this can comprise an acrylic resin sheet material such as, for example, the product sold under the trademark "Plexiglas" by the Rohm and Haas Co., Bristol, Pa.

Between the facing member and the backing panel 30, reflective surfacing 33 is provided, extending over the entire height and width of the backboard. In this connection, it is known to reflectively surface the back of the designated acrylic sheet resin product, in and of itself, and no claim is made to inventing a reflectively surfaced acrylic resin product in and of itself.

By reason of the provision of the reflective means 33, extending over the entire height and width of the backboard, the player P, standing upon the playing surface S, will observe his or her reflection in the backboard, and will also observe the reflection of the lines marked out upon the playing surface. As a result, when one stands on the playing surface S and looks at the reflectively surfaced backboard, the image of a complete tennis court is conveyed, since the playing surface S, which represents half of a conventional tennis court, is reflected in the backboard, so that one seemingly views the opposite half of the same court. One also observes, standing in the opposite court, his or her own image so as to further produce a realistic representation of a complete tennis court and an opponent, thus to more faithfully duplicate actual playing conditions for an individual who is practicing alone.

Between the transparent facing member 32 and the backing panel 30, in the preferred embodiment, there is provided a painting, decalcomania, or other realistic representation 34 of a tennis net of conventional height. This representation could be applied to the front surface of the transparent facing member 32 in some instances, but it is mainly important that the representation include the usual interstices that appear in any conventional tennis net, with the reflective surfacing being carried forth through all of the interstices of the net representation. In this way, when one views his or her own image above the net, there will also be observed the lower portion of the player's body, visible in the reflectively surfaced interstices of the net representation 34. This further heightens the realistic representation of a complete tennis court and the presence of an opponent.

In FIGS. 6 and 7, there is shown a modification which is identical in every respect to the first form of the invention, except for the fact that in this form, the front face of the facing member **32*a* is inclined slightly from the vertical, in respect to the reflective surfacing 33. This can be achieved in any of various ways, that is, the transparent facing member 32*a* could, for example, be progressively increased in thickness from the top to the bottom edge thereof, as shown in the drawing. Alternatively, sheet 32*a* could be of constant thickness from top to bottom, and could simply be tilted out of the vertical and suitably braced in respect to the vertical, reflectively surfaced backing panel 30**.

What is mainly important, in the modified form of FIGS. 6 and 7, is that by tilting of the front surface of the backboard, in a direction such that the face of the member **32*a* is tilted slightly out of the vertical, upwardly and away from the playing surface S, a more realistic rebounding effect is obtained, that is, a ball B that strikes the front surface of the member 32*a* will not tend to drop too rapidly as it rebounds toward the player P. Instead, as noted from the direction arrows associated with the legend "Rebound" in FIG. 6, a ball that is moving directly horizontally toward the surface 32*a*** rebounds from that surface upwardly at a slight angle from the horizontal as it travels back to the player, and thus will carry a greater distance back toward the player, in a more realistic simulation of an actual tennis match.

Conversely, the player's image is reflected directly horizontally toward the player, as shown by the direction arrows in association with the legend "Reflected Image". This is achieved by maintaining the reflective surfacing 33 perfectly vertical, while as above noted tilting the rebounding surface, that is, the front face, of member **32*a*** slightly out of the vertical a few degrees.

In both forms of the invention, a highly faithful simulation of a full size tennis court, and of an opponent, is achieved. The player P, as practice is continued, may for example desire to practice strokes away from his or her imaginary opponent as seen in the reflective surfacing 33. In doing so, obviously the ball will rebound laterally from the player's position, and the player is thus required to run back and forth across the playing surface S as practice continues, endeavoring each time to keep the ball away from the imaginary opponent who would also be moving cross-court in the reflective surfacing 33.

One can, of course, practice any type of tennis stroke, including serves, base line rallies, full volleys, and half volleys. In every instance, a faithful representation of what appears to be a full size court is afforded for the player, and interest in the practice is greatly heightened by the presence of his or her reflected image producing what appears to be a moving opponent.

Of prime importance, in addition to the reflection of the player, is the reflection of the ball. The position of the ball and its motion, as viewed in the reflective surface, causes the player to take on a new position, that is, he is trained in a highly effective manner, to observe the fundamental requirement of keeping his eye on the ball.

Thus, a right-handed player P (see FIG. 8) strokes the ball B at time $t_1$. Looking up at the reflecting surface 33 he sees his reflected image as a left-handed opponent P' hitting the ball cross court along an apparent trajectory $B'_1B_2$. Player P will then move to a new position $P_2$ in order to stroke the ball again and so the practice continues with P playing P' at time $t_2$.

Although trajectory $B'_1B_2$ is made up of real and imaginary parts $OB_2$ and $B'_1O$, to the player P it will appear as a continuous real trajectory upon which he can judge his motion and his next stroke.

Apart from the highly significant training effect schematically represented in FIG. 8, it may be appropriate to discuss further the modified form of FIGS. 6 and 7, that is, the impact of a tilted board—if one should be used—on the visual sense. Within a reasonable angle of tilt (see FIG. 9) of the reflecting surface the user can still see point F. Of course, should the player lower his body such that point E (his eye level) drops, there is less freedom in adjusting the angle of tilt a. The importance in viewing point F is not due alone to the fact that point F would represent a point on his body, but more importantly the ball could assume this position and the player would not be able to see it in his reflected image. If it were not for this consideration the reflecting surface would not theoretically have to extend to the playing surface.

Within these considerations, the angle a at which the reflecting surface 33 might be tilted, can be readily determined, should one select the option of a tilted reflective surface rather than one which is perfectly vertical.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. In a practice and training aid for tennis players, a backboard adapted for installation upon a playing surface comprising:

(a) a backing panel adapted to be mounted in a generally vertical position and having a front surface facing forwardly toward a player stationed upon the playing surface;

(b) a transparent facing member fixedly secured to and overlying the entire front surface of the backing panel and having a wholly flat front face presenting a rebound surface for a tennis ball, said front face, over its entire area, lying in a plane tilted slightly out of the vertical in a direction such that a tennis ball propelled by a player against the rebound surface in a horizontal path will rebound upwardly therefrom toward the player at a slight angle from the horizontal; and (c) a wholly flat mirror surface adapted to reflect the player's own image, interposed between the backing panel and the facing member and lying in a vertical plane whereby the player's image when viewed along a horizontal path at eye level is reflected along the same horizontal path as that along which it is seen by the player, said backing panel, facing member, and mirror surface being coextensive in height and width, the horizontal distance between said planes becoming progressively greater in a direction from the top to the bottom edges of said reflecting surface and said facing member, whereby a tennis ball propelled along a horizontal path by a player against the tilted front face of the facing member will rebound upwardly therefrom toward the player in a path inclined at a slight angle from the horizontal, while at the same time the player's reflected image as viewed along a parallel horizontal path in the vertical mirror surface through the transparent facing member will be reflected along the same horizontal path as that along which it is seen by the player.

2. In a practice and training aid as in claim 1, the further improvement wherein the facing member is progressively increased in thickness from top to bottom to effect said inclination of the front face thereof.

3. In a practice and training aid as in claim 2, the further improvement wherein a representation of a tennis court net is incorporated in the backboard in close proximity to the facing member in front of the mirror surface.

4. In a practice and training aid for tennis players, the improvement of claim 3 in which interstices appear in said representation corresponding to those occurring in a tennis court net, the reflective surfacing being provided within said interstices whereby the reflective image of the player will appear within said interstices.

* * * * *